US008475141B2

(12) United States Patent
DaRif

(10) Patent No.: US 8,475,141 B2
(45) Date of Patent: Jul. 2, 2013

(54) PUMP ASSEMBLY FOR HIGH PRESSURE CLEANERS

(75) Inventor: Italo DaRif, Summaga di Portogruaro (IT)

(73) Assignee: IP Cleaning S.p.A., Summaga di Portogruaro (Venice) (IT)

( * ) Notice: Subject to any disclaimer, the term of this patent is extended or adjusted under 35 U.S.C. 154(b) by 471 days.

(21) Appl. No.: 12/757,683

(22) Filed: Apr. 9, 2010

(65) Prior Publication Data

US 2010/0290927 A1 Nov. 18, 2010

(30) Foreign Application Priority Data

May 12, 2009 (IT) ..... MI20090154 U

(51) Int. Cl.
*F04B 27/08* (2006.01)
*F01B 3/00* (2006.01)

(52) U.S. Cl.
USPC ..... 417/271; 417/269; 92/71

(58) Field of Classification Search
USPC ..... 417/269, 271; 92/71
See application file for complete search history.

(56) References Cited

U.S. PATENT DOCUMENTS

| | | | | |
|---|---|---|---|---|
| 5,168,268 | A * | 12/1992 | Levy | 345/165 |
| 5,975,863 | A * | 11/1999 | Mazzucato | 417/269 |
| 6,056,515 | A * | 5/2000 | Cuneo | 417/271 |
| 7,258,531 | B2 * | 8/2007 | Kuhn | 417/269 |
| 7,658,597 | B2 * | 2/2010 | Rocchi et al. | 417/269 |
| 2006/0110265 | A1 * | 5/2006 | Lanfredi et al. | 417/269 |

* cited by examiner

*Primary Examiner* — Charles Freay
(74) *Attorney, Agent, or Firm* — Leydig, Voit & Mayer, Ltd.

(57) ABSTRACT

A pump assembly 10 for high pressure cleaners having a pump body 12 encasing the free end 14 of a motor shaft provided with a keyed-on wobble plate 16 which moves one or more than one axial pistons 18 that are elastically tensioned by helical springs 20. The pump assembly also includes a pump head 32 fixed to the pump body 12 provided with fluid inlet and outlet conduits and relative valves, and an intermediate housing 34 for receiving and guiding the piston 18. The intermediate housing 34 has a frustoconical-shaped body with its larger diametered bottom section facing the same-diametered pump body 12 and being secured thereto by screws 36.

7 Claims, 4 Drawing Sheets

PUMP ASSEMBLY FOR HIGH PRESSURE CLEANERS

CROSS-REFERENCE TO RELATED APPLICATIONS

This patent application claims the benefit of Italian Patent Application No. MI 2009 U 000154, filed May 12, 2009.

FIELD OF THE INVENTION

The present invention relates generally to an improved pump assembly for high pressure cleaners.

BACKGROUND OF THE INVENTION

The present invention more particularly relates to a vertical pump assembly for high pressure cleaners with wobble plate, advantageously connectable to an internal combustion engine the shaft whereof sets said plate in rotation; a pump assembly of this type is described, for example, in U.S. Pat. No. 5,494,414.

It is known that high pressure washing equipment, known by the term "high pressure cleaners", has long been used for cleaning work, especially of large surfaces.

This equipment is made according to various types for industrial, professional or hobby use and comprises a motor-pump assembly that pressurises the fluid, typically water with detergents, fed through an inlet conduit. Water under pressure comes out of an opposite conduit whereto a hose is connected; the latter is associated to a dispenser that may be actuated manually, which comprises a nozzle wherefrom water can come out with a more or less concentrated jet. Two or more dispensing nozzles are generally provided, to be used alternatively according to the needs. In this washing equipment, the wobble plate that moves the axial pistons is coupled to the motor shaft, generally an electrical motor. According to a traditional embodiment, the pistons are seated and guided in the axial sliding into a housing that is fixed to the body wherein the free end of the motor shaft protrudes; the wobble plate is keyed on the latter. Said body that seats the free end of the motor shaft at the bottom forms a connection flange to the motor, and as for the housing, it is generally made of aluminium or alloys thereof.

Both the housing and the body that seats the motor shaft end substantially have the same diameter and are connected to each other by screws, arranged along the periphery of the housing itself. The pump head develops above the latter, with the fluid conduits and the relative valves.

It has been noted that this traditional solution has a considerable drawback.

In particular, the housing is subject to very high working pressures in the central zone, which is significantly far from the peripheral parts wherein the connecting screws to the underlying body are arranged. A pressure level equal to about 2600 PSI is allowed in the presence of a mean thickness of the housing comprised between 3.0 and 5.0 mm referred to the central zone thereof. As a consequence, an increase of fluid pressure even as little as 5% may lead to dangerous effects due to the yielding of said housing. An increase in the working pressure should therefore be correlated to an increase in the housing thickness, especially in the central zone, but this would lead to an increase of both the overall weight and the production costs.

OBJECTS AND SUMMARY OF THE INVENTION

The object of this invention is to obviate the drawback mentioned hereinabove.

More in particular, the object of the present invention is to provide an improved pump assembly for high pressure cleaners wherein the housing that seats the pistons and the relative guides is made so as to withstand an increase in the working pressure of the fluid in terms of safety and without the need of a parallel increase of the overall or localized thickness thereof in one or more zones.

A further object of the invention is to provide an improved pump assembly wherein said housing should be capable of standing an increase in the fluid pressure higher than 5% in terms of safety, the thicknesses of the housing itself being equal. A further object of the invention is to provide the users with an improved pump assembly for high pressure cleaners suitable for ensuring high level of resistance and reliability over time, also such as to be easily and inexpensively constructed.

These and yet other objects are achieved by the improved pump assembly for high pressure cleaners of the present invention which comprises a body encasing the free end of a motor shaft provided with a keyed-on, wobble plate which moves one or more than one axial pistons that are elastically tensioned by helical springs, a pump head fixed to said body and provided with fluid inlet and outlet conduits and relative valves, further to an intermediate housing integrating the piston support and guide lodgings and which is characterised in that said housing features a frustoconical-shaped body with its larger diametered bottom section facing said same-diametered body, that it is secured onto by way of screws.

The construction and functional features of the improved pump assembly for high pressure cleaners of this invention shall be better understood from the following detailed description, wherein reference is made to the annexed drawings showing a preferred and non-limiting embodiment thereof, wherein:

Other objects and advantages of the invention will become apparent upon reading the following detailed description and upon reference to the drawings, in which:

Figure 1:
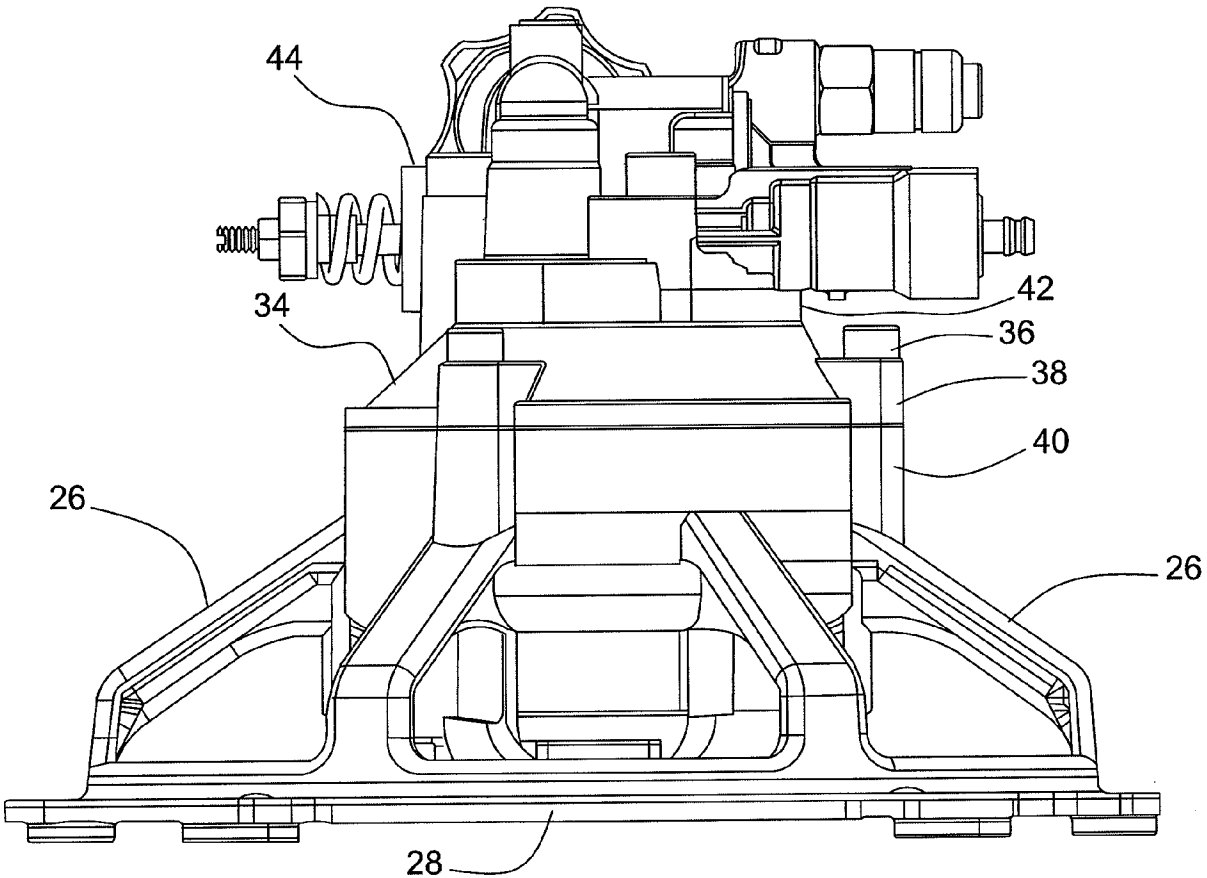
FIG. 1 shows a schematic side view of the improved pump assembly for high pressure cleaners of this invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DESCRIPTION OF THE PREFERRED EMBODIMENTS

With reference to said figures, the improved pump assembly for high pressure cleaners of the present invention, globally indicated with (10) in FIG. 1, comprises a body (12) that seats the free end (14) of a motor shaft whereon the conventional wobble plate (16) is keyed, suitable for axially moving one or more pistons (18); these last mentioned are elastically tensioned by helical springs (20). The wobble plate (16), which is substantially mushroom-shaped according to a known embodiment, is supported by one or more thrust bearings (22) and in the front side suitable for abutting the pistons (18) it comprises a fifth wheel (24) or the like.

Figure 2:
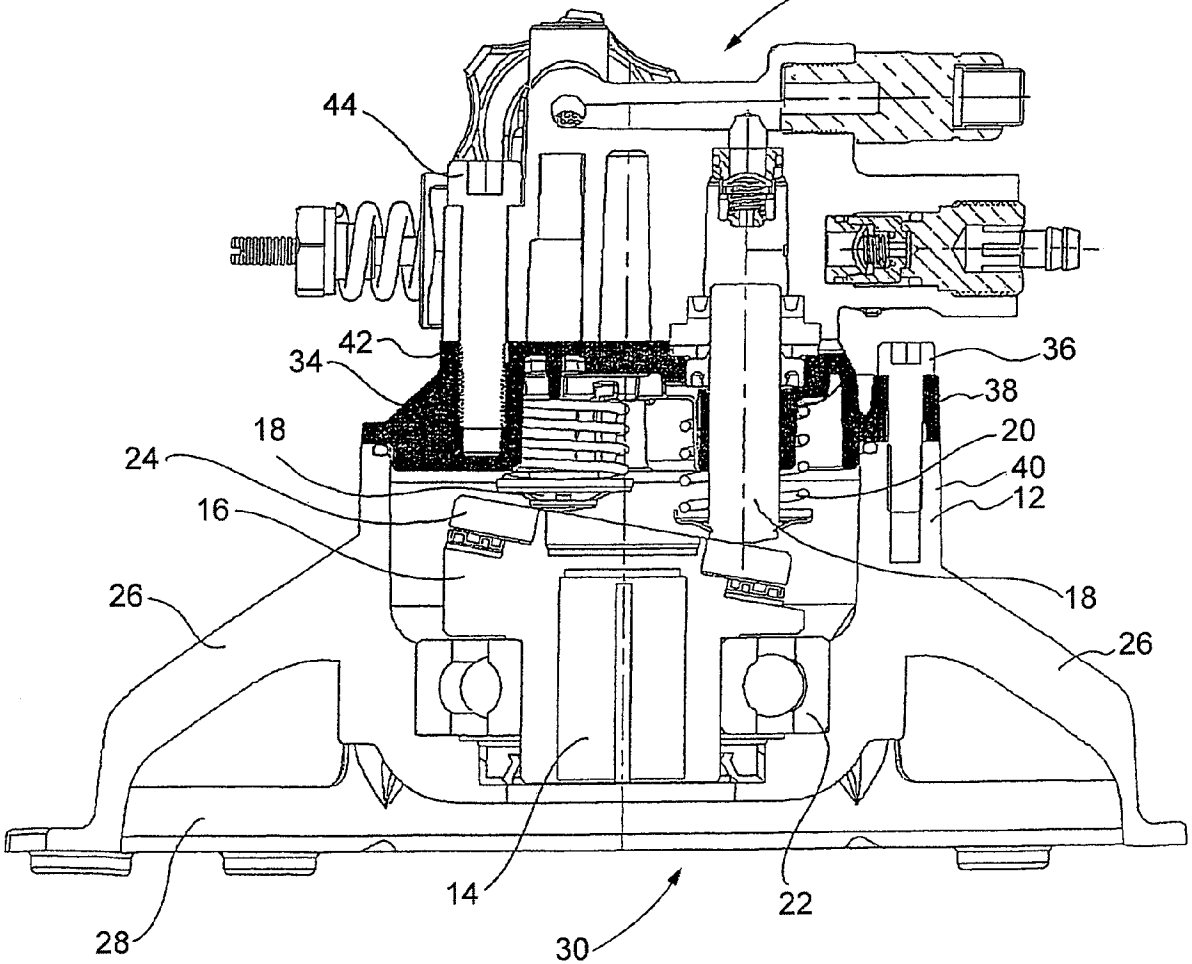
FIG. 2 shows a schematic view of a longitudinal section of the same improved pump assembly.
Figure 3:
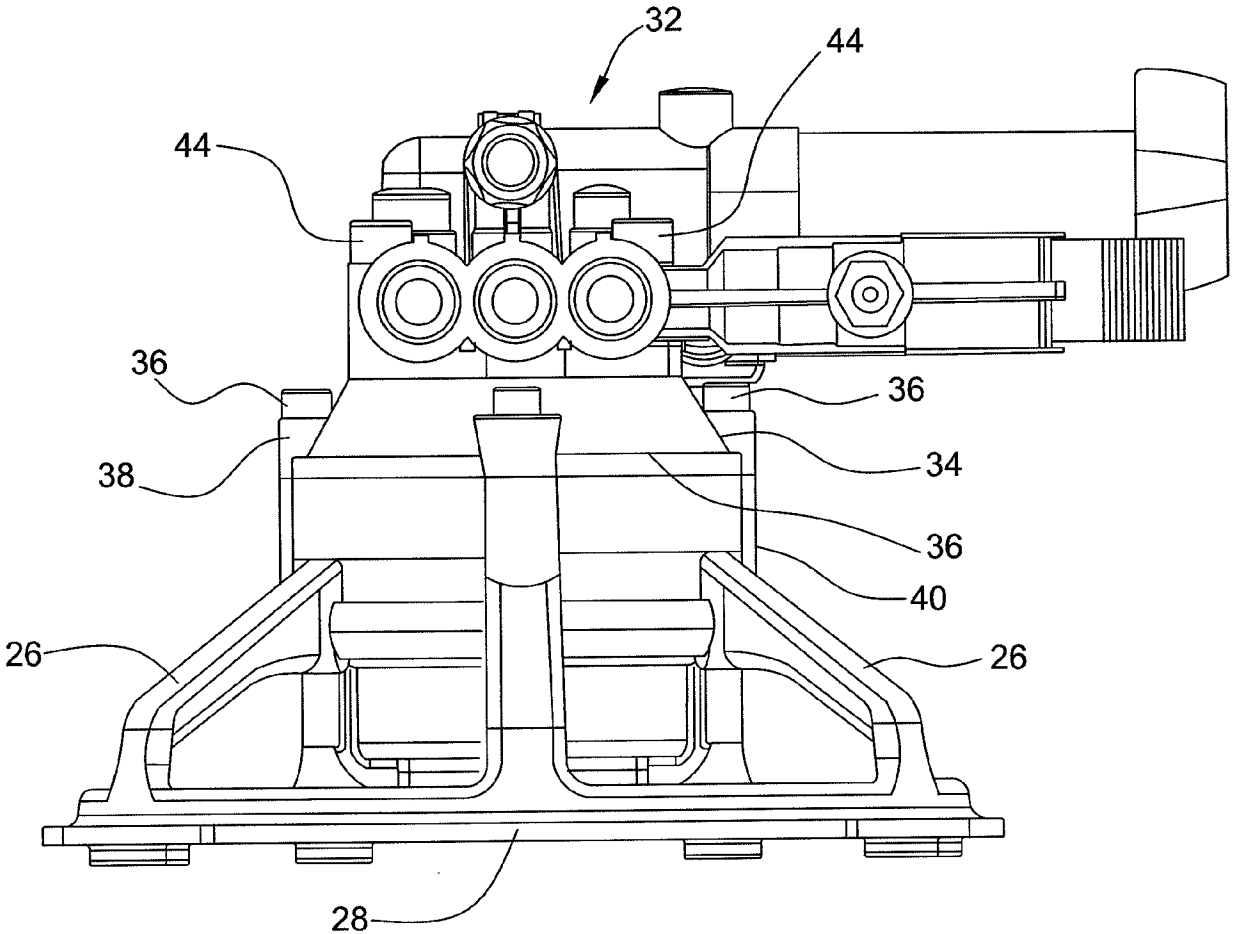
FIG. 3 shows a schematic view of a further side view of the same improved pump assembly.

The bottom side of the body (12) is provided with a plurality of radial arms (26) that joint ring-wise (28) globally forming a fixing flange (30) to the explosion engine (not shown). The pump head, globally schematised with (32) in FIG. 2, which comprises the fluid inlet and outlet conduits and the relative valves, is fixed to said body (12). A housing (34) is arranged between the body (12) and the head (32), made up of an intermediate body wherein the support and guiding seats of the pistons (18) are obtained. According to the invention, the housing (34) advantageously defines a frustoconical-shaped development wherein the bottom base, with larger diameter, faces the body (12) and has the same diameter as the body itself, whereto it is fixed by screws (36), preferably three arranged at 120°. The screws (36) are inserted in lodgings (38) that develop projecting along the periphery of the body (12) and align with corresponding sleeves (40) made integral with the body itself (12).

According to a further advantageous feature of the invention, the opposite end or top base with smaller diameter of the housing (34) has an integral shaped plate (42), of limited height and by way of an example comprised between 3.0 and 8.0 mm along the periphery whereof there are obtained three seats at 120° for as many screws (44); the screws (44) constrain the head (32) to the housing (34).

Figure 4:
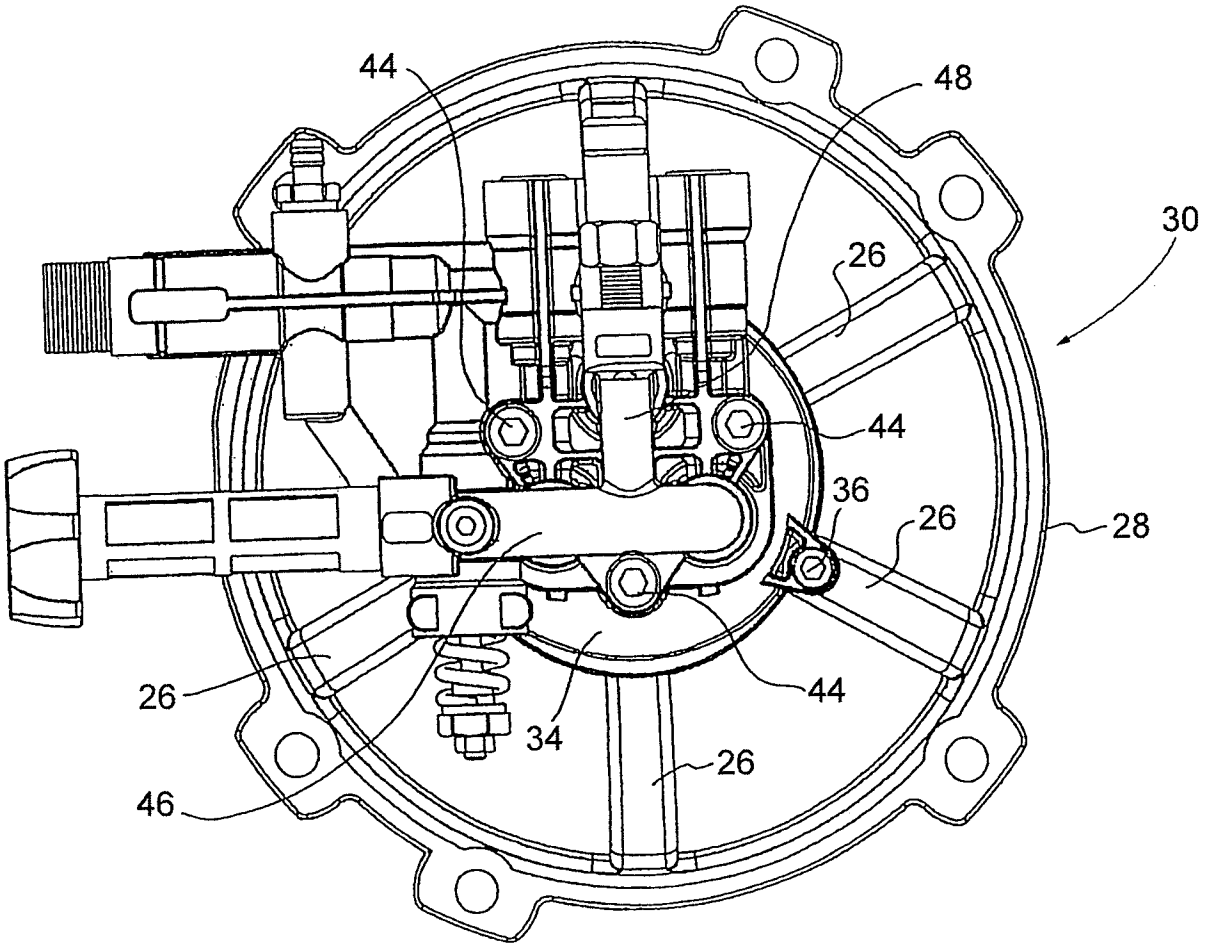
FIG. 4 shows a schematic plan view of the same improved pump assembly.

Inside the zone delimited by the screws (44), the head (32) defines two projecting conduits, having substantially semicircular section, which develop orthogonally to one another forming a "T" element that strengthens the central part of the head itself. The longest branch, indicated with (46) in FIG. 4 of the "T" element is the end of the fluid inlet conduit, whereas the shortest branch of the same "T" element, indicated with (48) in the same figure is the discharge conduit of the thermostatic valve.

According to this embodiment, the part of the head (32) suitable for coupling with the housing (34) is significantly strengthened. In fact, in the first place the frustoconical configuration of the housing (34) in the top part, where the integral plate (42) is created, forms a significantly smaller diameter than that of the base thereof the screws (44), as a consequence, are much closer to the central zone of the head (32) which is subject to the greatest strain due to the inner fluid pressure. Secondly, the innovative "T" arrangement of the branches (46) and (48) belonging to the fluid inlet conduits and to the discharge conduit of the thermostatic valve causes, especially along said central zone of the head (32), an extended rib that further contributes to strengthening the head itself.

It has been found that thanks to this structure of the housing (34) and of the head (32) it is possible, with the same thicknesses of the above components, to increase in terms of safety the working pressure of the fluid according to a percentage equal to at least 5% compared to known solutions wherein the housing is cylindrical, without causing an increase in weight and without additional costs.

Although the invention has been described with particular reference to an embodiment thereof, made by way of a non-limiting example, several changes and variations will appear clearly to a man skilled in the art in the light of the above description.

The present invention therefore is intended to include any changes and variations thereof falling within the spirit and the scope of protection of the following claims.

The invention claimed is:

1. A pump assembly (10) for high pressure cleaners, comprising a pump body (12) encasing a free end (14) of a motor shaft provided with a keyed-on, wobble plate (16) which moves one or more than one axial pistons (18) that are elastically tensioned by helical springs (20), a pump head (32) fixed to said pump body (12), said pump head (32) having fluid inlet and outlet conduits and relative valves, an intermediate housing (34) for receiving and guiding the one or more than one pistons (18), said intermediate housing (34) having a frustoconical-shaped body with a larger diametered bottom section facing a same-diametered pump body (12) and being secured thereto by screws (36).

2. The pump assembly according to claim 1, characterised in that said screws (36) are three screws arranged at 120° spacing and inserted into corresponding lodgings (38) formed by projecting appendix elements located along a periphery of the pump body (12), and said lodgings (38) being aligned with respective sleeves (40) built into the pump body (12).

3. The pump-motor assembly according to one of the previous claims, characterised in that a smaller diametered top section of the housing (34) extends into an integral cylindrical plate (42) that along its periphery is provided with three lodgings arranged at 120° to lodge a likewise number of secured screws (44) suitable for connecting the housing (34) to the pump head (32).

4. The pump assembly according to claim 3, characterised in that said cylindrical plate has a height of between 3.0 and 8.0 mm.

5. The pump assembly according to claim 3, characterised in that internally to an area delimited by said secured screws (44) said pump head (32) has two projecting conduits each of a substantially semicircular section, in which respective legs (46), (48) face each other orthogonally to form a "T" shaped element.

6. The pump-motor assembly according to claim 5, characterised in which one leg (46) of the "T" shaped element defines a longer extension path, thereby constituting an extremity of the fluid inlet conduit.

7. The pump-motor assembly according to claim 5, characterised in one leg (48) of the "T" shaped element includes a shorter extension path, thereby constituting a thermostatic valve discharge conduit.

* * * * *